US005257423A

United States Patent [19]

Jacobsen et al.

[11] Patent Number: 5,257,423

[45] Date of Patent: Nov. 2, 1993

[54] SERVICE ISLAND WASH STATION ENCLOSURE

[75] Inventors: Sam J. Jacobsen, Middleton; James L. Georgeson, New Lisbon, both of Wis.

[73] Assignee: Leer Manufacturing Limited Partnership, New Lisbon, Wis.

[21] Appl. No.: 898,901

[22] Filed: Jun. 12, 1992

Related U.S. Application Data

[63] Continuation-in-part of Ser. No. 635,847, Dec. 31, 1990, abandoned.

[51] Int. Cl.[5] ..... A47K 1/04

[52] U.S. Cl. ..... 4/630; 4/638; 312/228

[58] Field of Search ..... D15/9.1-9.3; 141/98; 4/619, 625-631, 638, 643, 644, 646, 652, 650, 653, 654, 665; 312/228, 229

[56] References Cited

U.S. PATENT DOCUMENTS

| | | | |
|---|---|---|---|
| D. 168,142 | 1/1953 | Troik | D15/9.2 |
| 173,662 | 2/1876 | Pease . | |
| 180,814 | 8/1876 | Zinn . | |
| D. 207,602 | 5/1967 | Freed | D15/9.2 |
| 1,027,928 | 5/1912 | Stockman . | |
| 1,263,384 | 4/1918 | DeLabaume | 312/228 |
| 1,297,630 | 3/1919 | Zawisa | 4/626 X |
| 1,840,033 | 1/1932 | Hampton | 312/228 X |
| 2,616,095 | 11/1952 | Stuckey | 4/166 |
| 2,786,211 | 3/1957 | Culver | 4/626 |
| 2,898,606 | 8/1959 | Feller | 4/166 |
| 3,010,774 | 11/1961 | Doherty | 312/228 X |
| 3,041,957 | 7/1962 | Liptay | 312/228 X |
| 3,473,173 | 10/1969 | Maciulaitis et al. | 4/626 |
| 3,582,173 | 6/1971 | Noren et al. | 312/228 X |
| 3,594,830 | 7/1971 | Clifton | 4/187 |
| 3,748,437 | 7/1973 | Keeshin et al. | 4/626 X |
| 3,983,583 | 10/1976 | Herman et al. | 312/228 X |
| 4,072,157 | 2/1978 | Wines, Jr. et al. | 134/58 |
| 4,398,310 | 8/1983 | Lienhard | 4/628 X |
| 4,747,169 | 5/1988 | Valbuena | 4/625 |
| 4,765,003 | 8/1988 | Chang | 4/624 |
| 4,769,863 | 9/1988 | Tegg et al. | 4/625 |
| 4,942,631 | 7/1990 | Rosa | 4/630 X |

FOREIGN PATENT DOCUMENTS

| | | | |
|---|---|---|---|
| 1205017 | 11/1965 | Fed. Rep. of Germany | 4/638 |

OTHER PUBLICATIONS

Bennett "Profiles" pp. 12-15 brochure of Bennett Pump Division pub date:not known.

*Primary Examiner*—Charles E. Phillips
*Attorney, Agent, or Firm*—Lathrop & Clark

[57] ABSTRACT

A wash station enclosure for installation proximate self-service gas pumps and for use by users of said pumps has a cabinet with a top surface with a flush-mounted washbasin therein. A spigot protrudes above the washbasin and communicates with a freshwater tank within the cabinet. An overhang is supported by two vertical supports which are affixed to the sides of the cabinet and support the overhang over and above the washbasin to form a sheltered space. The water within the freshwater tank is kept at a comfortable hand washing temperature by an electric heater. An electric pump communicates with the freshwater tank to cause water to flow from the tank to the spigot in response to activation of a switch. Heat lamps are mounted in the overhang soffit. The heat lamps are activated at the same time as the water flow to illuminate the washbasin and the area around it and to warm the hands of a user of the wash station by infrared radiation. The wash station enclosure is connected to the pavement in a service zone defined between vehicle traffic lanes and is accessible to both lanes.

18 Claims, 4 Drawing Sheets

SERVICE ISLAND WASH STATION ENCLOSURE

This application is a continuation-in-part of application Ser. No. 07/635,847, filed Dec. 31, 1990 now abandoned.

FIELD OF INVENTION

This invention relates to stations for washing hands in general and wash stations for outdoor use in particular.

BACKGROUND OF THE INVENTION

Self-service gas pumps, which may be located at a gas station or full-service convenience store, provide economic and convenience advantages to consumers. Although self-service pumps have lowered the cost of gas and diesel fuel to the consumer, the consumer is often faced with the prospect of soiling his hands with gasoline, diesel fuel, oil or washer fluid. A consumer, whose hands have been so contaminated, is faced with the unpleasant prospect of blocking access by other customers to the pumps while he goes off in search of a washroom. Most often he will bow to the exigencies of the circumstance and return to his car with soiled hands.

Driving with soiled hands may be unpleasant and is undesireable. Automobile fuels are highly aromatic and may contain skin irritants which should not be left in contact with the skin for extended periods of time. Moreover, in the fast-paced press of everyday activities, the operator of a motor vehicle will often find it convenient to eat while situated in his car. Convenience store operators and fast food franchises often provide hot menu items for pickup by the drive-thru or walk-up customer. In situations where convenience meals are to be consumed in the car, it is particularly important not to leave the self-service gas pump with hands soiled with aromatic petrochemicals.

Portable hand washing stations are known which fit within a car and supply warm water for the washing of hands. However, this is a costly and not widespread solution and leaves to the vehicle operator the task of resupply and maintenance of such a portable lavatory.

Portable sinks for use by campers or in association for portable toilets are known but are not designed with the particular needs of the consumer of self-service gas.

Hand wash stations for use by gas station attendants and mechanics which recirculate the washing fluid are known, but these have been located indoors in garages and do not incorporate features designed for the shelter and convenience of the consumer.

Portable hands-free wash stations for use in small restaurants and the home, which incorporate foot pedals, soap dispensers, hot air hand dryers and vanities are known, however, these are not designed to be conveniently placed at a self-service gas pump and are not designed to meet the requirements of outdoor washing of hands in all weather conditions.

What is needed is a hand washing station which may be conveniently integrated in proximity to self-service gas pumps which is adapted for hands-free all-weather operation.

SUMMARY OF THE INVENTION

The outdoor wash station of this invention for placement proximate to self-service gas pumps has a cabinet with a top surface with a flush-mounted washbasin therein. A spigot directs water into the washbasin and communicates with a wash water tank within the cabinet. An overhang is supported by two vertical supports which are affixed to the sides of the cabinet and support the overhang over and above the washbasin to form a sheltered space. Radiant heat units are mounted in the overhang soffit which illuminate the washbasin and the area around it and which, during cold weather, warm the hands of a user of the wash station by infrared radiation. The water within the wash water tank is kept at a comfortable hand washing temperature by an electric heater. An electrically driven pump communicates with the wash water tank to cause water to flow from the tank to the spigot in response to activation of a switch.

It is an object of the present invention to provide a hands-free washbasin for use by customers of self-service gas pumps.

It is a further object of the present invention to provide a hand wash station which is functionally integrated with self-service gas pumps by serving as a support for and having attached windshield washer units and waste containers.

It is another object of this invention to provide a hand wash station which may be used outdoors in all weather.

It is also an object of the present invention to provide a hand wash station wherein the water is heated to a comfortable temperature for the washing of hands.

It is an additional object of the present invention to provide a hand wash station which may be installed without connection to water and sewage lines.

Further objects, features and advantages of the invention will be apparent from the following detailed descriptions when taken in conjunction with the accompanying drawings.

DESCRIPTION OF THE BEST MODE CONTEMPLATED

Figure 1:
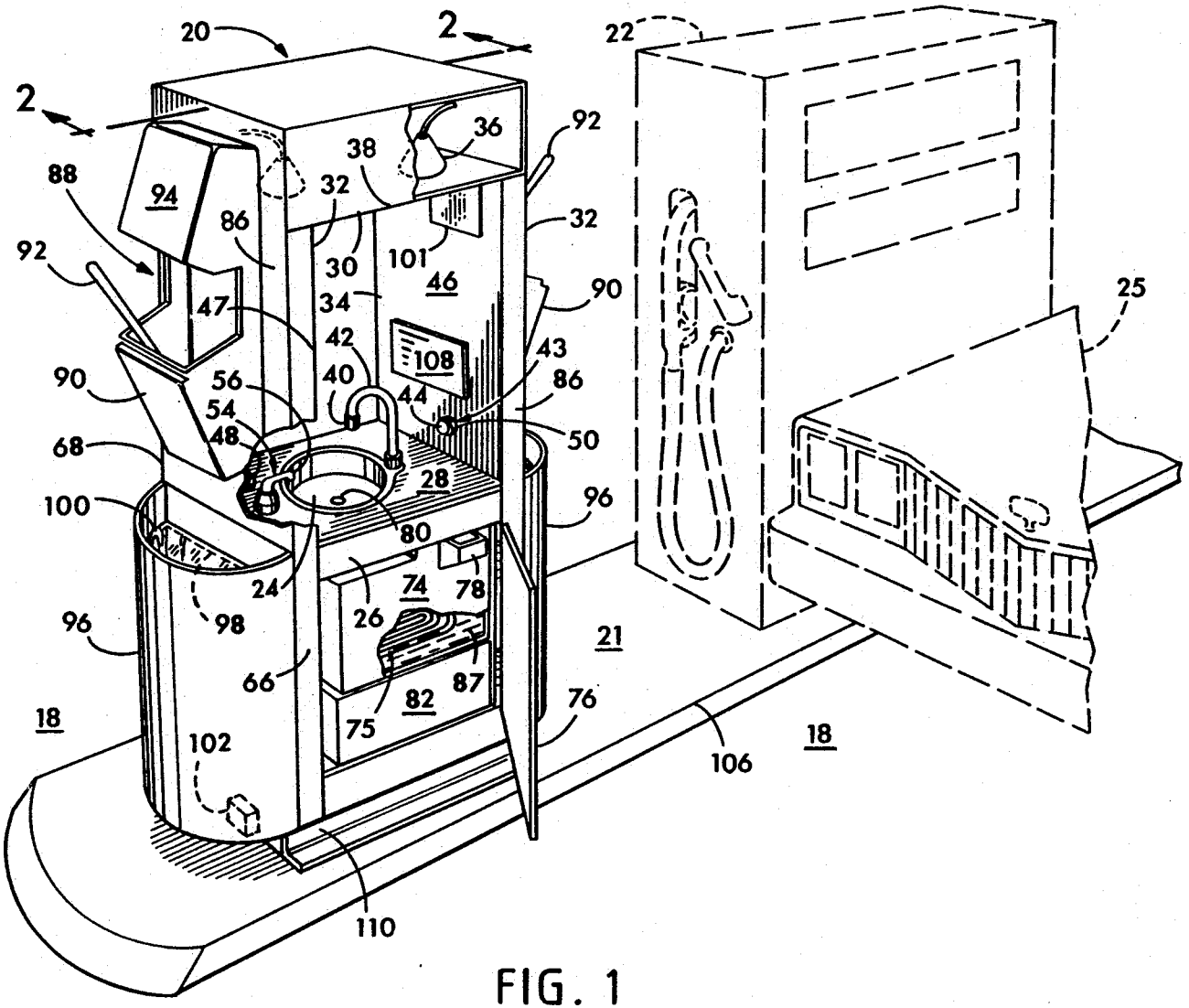
FIG. 1 is a front isometric view partly cut away of the wash station of this invention.

Referring more particularly to FIGS. 1-4, wherein like numbers refer to similar parts, a wash station assembly 20 is shown in FIG. 1. The wash station 20 is designed to be situated in proximity to gas pumps 22 where cars 25 are refueled. The wash station serves as an integrated part of a self-sevice refueling station. The wash station 20 forms a protected enclosure between two traffic lanes 18, where users of gas pumps may clean their hands. A service zone 21 is defined between the two traffic lanes 18. Within the service zone are positioned all the apparatus and cabinetry for service to a motor vehicle. The wash station 20 is contained within the service zone 21 and does not protrude beyond the zone 21 to block traffic in any way. As shown in FIG. 1, the service zone 21 may correspond to the dimensions of an elevated service island 106, or it may be defined by conventional pavement markings, barriers, or simply the dimensions of the pumps themselves. As illustrated in FIG. 1 and shown in cross-section in FIG. 2, the wash station 20 has a wash basin 24 mounted in the top 28 of a cabinet base 26. The wash basin 24 is set within and substantially flush with the cabinet top 28. A spigot 42 protrudes above the cabinet top 28 and has an outlet 40 which is spaced above the washbasin 24. The outlet is disposed to direct water into the washbasin. Mounted over the washbasin is a cabinet overhang 30 supported by two vertical cabinet support members 32 which extend transverse to said elongated service zone and together with the overhang define a sheltered space 34 above washbasin 24. The sheltered space 34 is illuminated and warmed by heat lamp radiant heat units 36 mounted in the soffit 38 of the overhang 30. These heat lamps 36 project infrared radiation onto the hands of the self-service gas customer when they are in the vicinity of the washbasin 24. The wash station 20 also has lights, not shown, for illuminating the cabinet top 28, which are also mounted in the soffit 38. The hands of a user are warmed by the heat lamps 36 overcoming the chilling normally experienced when wet hands are exposed to cool or dry air.

The vertical support members 32, together with the overhang 30 define an enclosure which is open to the front 66 and to the rear 68. The front 66 of the wash station 20 lies alongside and opens towards one traffic lane 21, while the rear 68 of the wash station lies alongside and opens towards the other traffic lane 21. Thus a motorist may, after refueling his car, approach the hand wash station from the traffic lane in which his car is parked without the need to cross the service island 106, or otherwise intrude into the vicinity of another parked vehicle.

The vertical support members 32 shield the user of the washbasin from wind and horizontal gusts of rain and snow. The overhang 30 likewise shields the user's hands from the elements. The enclosure thus projects an atmosphere of protected comfort, yet is immediately accessible and instantly visible prior to use. A user desiring to wash his hands need not leave his vehicle unattended and need have no apprehension as to the conditions of the wash area.

Figure 2:
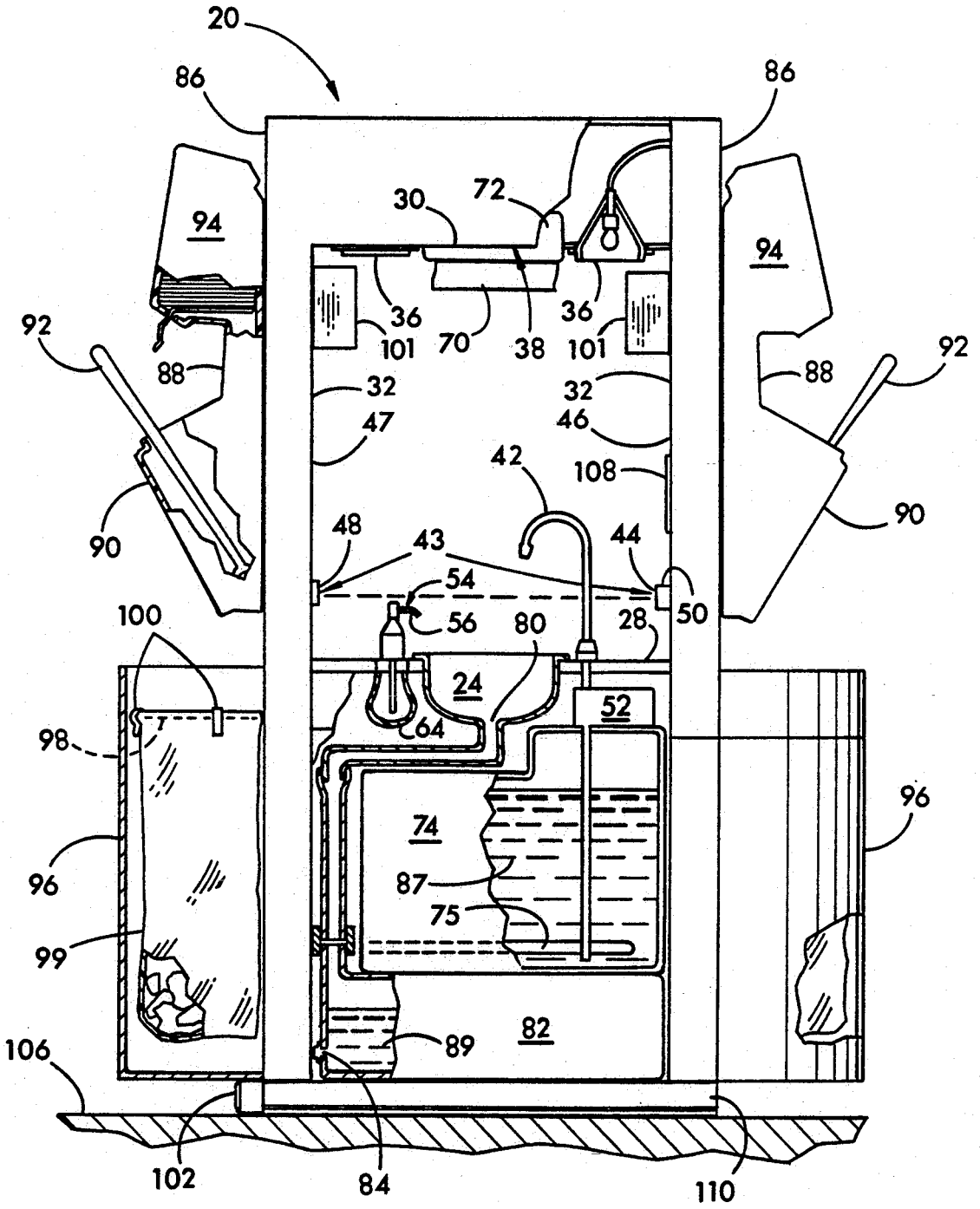
FIG. 2 is a cross-sectional view of the wash station of this invention taken along section line 2—2.

As best seen in the cutaway portions of FIG. 1 and the cross-sectional view of FIG. 2, the internal volume of the cabinet base 26 contains the apparatus for supplying warm water to the spigot 42 and draining wastewater from the washbasin 24. A freshwater tank 74 is mounted within the cabinet 26 beneath the washbasin 24 behind the front cabinet door 76. The freshwater tank has a fill port 78 which protrudes outwardly from the tank. Fresh water may be supplied from a hose or bucket through the fill port 78 to fill the freshwater tank 74. The freshwater tank 74 holds approximately 15 gallons which is sufficient water for approximately 150 hand washing cycles, a hand washing cycle being initiated each time the beam of a laser beam switch 43 is broken. Disposed within the freshwater tank 74 is an electric water heating element 75 which warms the freshwater 87 to a lukewarm temperature suitable for hand washing. The freshwater tank 74 is connected to an electrically driven pump 52 which communicates with the spigot 42 and is actuated by the switch 43. Upon activation, the pump 52 continues to pump water until a time delay circuit, not shown, shuts off the pump after a predetermined period of time. Approximately a tenth of a gallon of water is a desireable quantity to be dispensed in a single cycle.

The washbasin 24 has a drain 80 which communicates with a wastewater tank 82 with a volume preferably the same or slightly greater than that of the freshwater tank. The wastewater tank 82 has a drain valve 84 fitted with a standard hose fitting by means of which the wastewater 89 may be drained into a sewer or a wastewater cart.

Under normal operation, the 150 hand washing cycles are sufficient to last through an entire eight-hour shift. At the end of a shift the water 89 may be drained from the wastewater tank 82 and the freshwater tank 74 may be refilled.

A switch 43, with a laser 44, a reflector 48, a receiver 50, and a switching element (not shown) is located within the wash station 20 for activation of water 87 flow and the heatlamps 36. The switch 43 projects a beam of light from the laser 44 which is mounted on the inside wall 46 of the vertical support 32. The laser beam passes above the washbasin 24 and is reflected off the reflector 48 mounted on the opposite inside wall 47 of the other vertical support 32. The reflected beam returns to the receiver 50 co-mounted with the laser 44. The placing of an obstruction, such as hands, above the washbasin obstructs the beam and so triggers the switching element, not shown, which initiates a pump 52 and a shut-off delay circuit, not shown, which initiates the flow of water from the spigot 42 for a fixed period of time, preferably five seconds. The overhead heatlamps 36 are also activated by the switch 43 for a longer period of time, approximately 20 seconds, to radiate heat into the sheltered space and to warm a user's hands while they are washed and dried within the sheltered space 34.

The switch 43 controls a time delay circuit, not shown, which activates the pump 52 to cause water to flow, and also activates the heat lamps.

A hand-operated soap dispenser 54 is mounted on the countertop 28. The soap dispenser 54 has a spigot assembly 56 through which soap is dispensed onto the hands from a soap container 64 mounted within the cabinet 26 by a pumping action.

To operate the hand wash station of this invention, the customer approaches the station 20 from either the front 66 or the rear 68 and places his hands above the washbasin 24. This placement of the hands beneath the spigot 42 intercepts the laser beam passing over the washbasin 24 and initiates a flow of warm freshwater from the water spigot onto the user's hands and into the washbasin 24. The customer may then obtain soap from the soap dispenser 54. After thoroughly rinsing his hands in the washbasin 26 the customer may obtain a handwipe 70 from the overhead handwipe dispenser 72 which is mounted in the soffit 38 of the overhang 30.

The inside wall of the vertical supports 46 preferably have indicia 108 describing the operation of the wash station 20 such as "Place Hands Over Bowl and Warm Water Will Flow".

The wash stand of the this invention forms an integral part of a self-service automobile refueling station as shown in FIG. 1. The wash station is thus preferably the central location for apparatus and consumables required for performing routine cleaning of automobile windshields and other maintenance operations. The vertical support members have left and right outside facing sides 86 upon which are mounted conventional known windshield washing units 88 or water buckets. The windshield washing units 88 conventionally have a squeegee bucket 90, a squeegee 92, and a windshield wipe dispenser 94. Self-service refueling stations are commonly provided with trash containers for receipt of oil cans, soiled wipes, and other debris. To be retained in an upright position, these containers require some rigid support. The trash containers 96 are advantageously and conveniently integrated with the wash station 20. The trash containers 96 are semi-cylindrical and are attached to the sides of the cabinet 26 and disposed beneath the windshield washing units 88 on the outside of the vertical supports 32. The semi-cylindrical trash containers 96 have a semi-circular trashbag support ring 98 over which the top edge of a trash bag 99 may be folded and retained by a trashbag clip 100.

As an additional convenience feature, angled mirrors 101 are placed on the vertical supports 32 above the cabinet 26.

The only connection to utilities required by the wash station 20 is an electrical power connection 102 which supplies the power for the heat lamps 36, the water heating element 75, the water pump 52, the laser switch 43, and the time delay circuitry. The wash station 20 is permanently mounted by bolting the cabinet 26 to mounting flanges, not shown, which are either cast in the underlying concrete foundation or bolted with conventional anchor bolts. The kickplate 110 seals the base of the cabinet 26 against dirt and debris. As illustrated in FIG. 1 the wash station 20 is preferably mounted slightly above grade on an island 106. The raised wash station is thereby protected from damage by close proximity to car doors and bumpers.

It should be understood that wherein heat lamps mounted in the soffit are shown, this function could be supplied by any radiant heat unit.

Although a laser beam switch is described and illustrated to initiate the flow of wash water, it should be understood that the flow might be initiated by a switch using a simple light beam, an ultrasonic detector, an infrared light beam, a capacitance detector, or an ordinary hand or foot switch. While the means for supplying the freshwater through the spigot 42 is preferably an electric pump, the supply tank may be pressurized with air, with the water flow controlled by a valve between the tank and the spigot. Alternatively, the freshwater tank may be placed anywhere in or on the cabinet structure above the spigot so that gravity causes the water flow from the spigot when a valve is opened.

Figure 3:
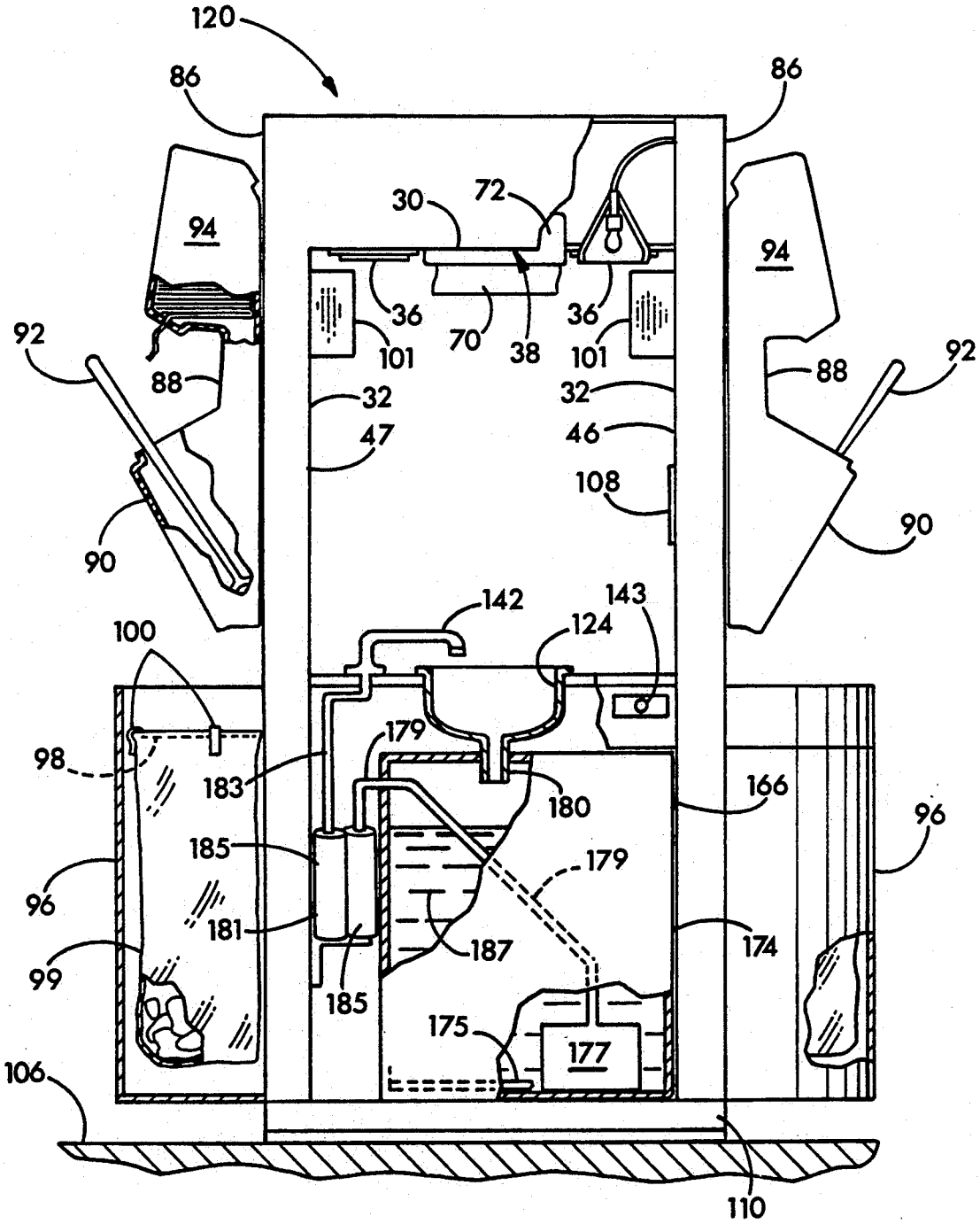
FIG. 3 is a partial cross-sectional view of an alternative embodiment of the wash station of this invention employing a filtered recirculated water supply.

An alternative embodiment of a wash station of this invention is shown in FIG. 3. The alternative wash station has an enclosure formed by the upright supports 32 and the overhang 30 identical to the station 20. The wash station 120 employs a system for purifying and recycling the wash water so that it may be recycled. The recycling wash station 120 has a washbasin 124 which communicates by a drain 180 to a wash water holding tank 174. The holding tank 174, which may be constructed of stainless steel, aluminum, plastic or the like, has a tank heater 175 closely spaced from the bottom of the tank which serves to keep the wash water warm.

Disposed within the bottom of the holding tank 174 is a submersible pump 177 which communicates by means of a plastic hose 179 with a filter system 181. From the filter system 181, the water flows through a second hose 183 to a water spigot 142.

The recycling wash station 120 performs a similar function to the wash station 20. A user's hands are placed over the washbasin 124 where activation of an "on" switch 143 on the front 166 of the cabinet causes water to flow for a predetermined time, preferably five seconds, which will cause approximately ⅛ of a gallon of water to flow from the spigot. The used wash water, together with any soap or contaminants from the user's hands, flows through the drain 180 of the washbasin 124 and accummulates in the holding tank 174.

The pump 177 pumps the used wash water from the bottom of the holding tank 174 to the filter system 181 through the hose 179. The filter system 181 employs a set of two filters 185. Each filter preferably is a modular cannister containing fine grain activated charcoal which is effective at removing chemical residuals and impurities from the water. Activated charcoal will not only remove substantially all hydrocarbons but will remove soap, particularly soaps which are petroleum-based or contain phosphates or alkaline chemicals. The fine grain activated charcoal is also effective at removing particulates and thus rendering the water clear and colorless. The filter system of two filter cannisters allows for interchangeable insertion of filter cannisters containing different filter media to accommodate the particular nature of the wash water and the contaminants to be filtered therefrom.

After filtration, the wash water flows directly to the spigot 142 for use in cleansing a user's hands. The wash water 187 is thus recycled within the wash station 120 flowing from the spigot 142 in the wash basin 124, down the drain 180 and into the holding tank 174, from whence it is pumped through the filter 181 into the spigot 142.

To prevent the survival of virus particles or the growth of bacteria, it is desirable to employ a hand wash soap containing a broad spectrum anti-microbial agent, such as Triclosan. Alternatively, a biological filter may be employed as part of the filter system 181.

Because liquid soap is subject to freezing and requires frequent replenishment, a dry soap dispenser 191 is preferably employed with the wash stations 20, 120 and 220 of this invention. One type of dry soap dispenser which may be employed with the wash stations of this invention is the CLEAF* system manufactured by Parachem Corporation of Des Moines, Iowa, as shown in FIG. 3, which dispenses up to 1,000 thin sheets 192 of soap from a single refill unit. This soap system can be supplied with soap containing the antibacterial agent Triclosan.

The recycling hand wash station 120 permits extended use of the station without the need to supplement or replace the water supply. The recycling wash station 120 may require the replacement of the filter cartridges 185 and the wash water 187 as infrequently as once every six months depending on the volume of use.

The recycling wash station 120 has a counter (not shown) which counts the number of times the wash station 120 is activated by means of the "on" switch 143. The number of wash cycles indicates when the filter 185 of the filter system 181 requires replacement and the holding tank 174 requires filling. The recycling wash station 120, while reducing servicing frequency and costs, by recycling the water also effects a substantial savings in water usage. Conservation of water will be important in areas experiencing drought or where water is normally in short supply.

Figure 4:
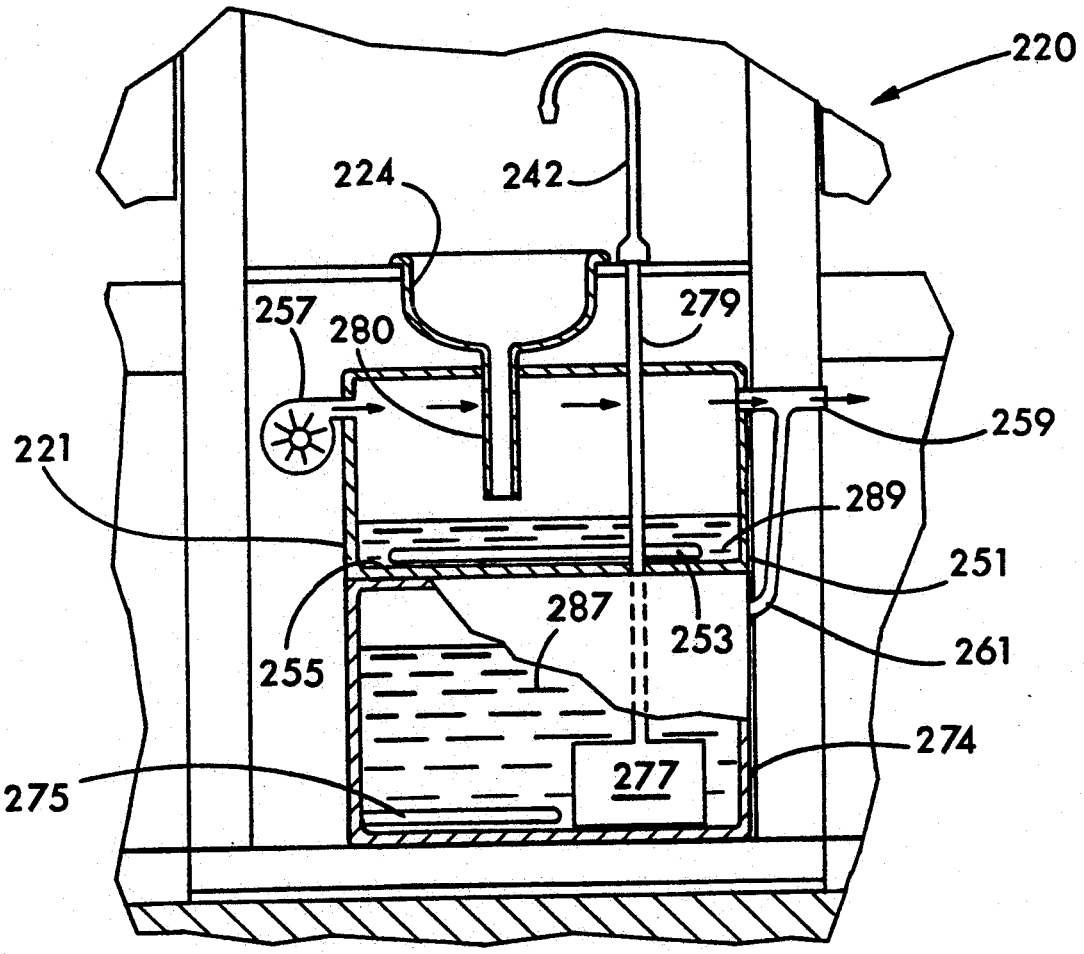
FIG. 4 is a partial cross-sectional view of another alternative embodiment of the wash station of this invention employing a wastewater evaporator.

A second alternative wash station 220, shown in FIG. 4, employs an evaporator 221 for disposal of the wash water 289. The flow of water is initated in the wash station 220 as in the wash stations 20 and 120 and employs similar activation means (not shown). The water 287 supplied to the spigot 242 from pump 277 through line 297 is used for washing of the hands and then passes into the washbasin 224 and passes down the drain 280 to an evaporator pan 251. The pan is disposed above the wash water supply tank 274. The evaporator pan has an electric resistance heater rod 253 spaced from the bottom 255 of the evaporator pan 251. A sensor (not shown) detects the presence of water 289 on the evaporator pan 251 and turns on the heater 253 and a blower 257. The blower 257 supplies outside air which passes over the evaporating pan 251, picks up water vapor, and exits through an exhaust tube 259. The blower exhaust tube 259 has a condensation drain 261 which recycles a portion of the wash water 287 which condenses in the tube 259. The wash water tank 274 has a heater 275 for warming wash water 287.

The evaporator wash station 220 requires only the filling of the wash water supply tank, and because of the recovery of condensation from the exhaust 259 through the exhaust drain 261, refilling is required less frequently than for freshwater tank 74 of FIGS. 1 and 2.

In all embodiments, it should be understood that a laser switch, a foot or hand switch, a light beam detector, or an ultrasonic or capacitance detector may be employed for initiating water flow and heat lamp operation.

Although an electrical time delay circuit has been described for activating the water flow and radiant heat units, it should be understood that any effective mechanical or fluid time delay apparatus would also be appropriate.

It is understood that the invention is not confined to the particular structure and arrangement of parts herein illustrated and described, but embraces all such modified forms thereof as come within the scope of the following claims.

We claim:

1. An outdoor hand wash station in combination with an elongated service zone defined between two vehicle traffic lanes, said wash station being installed proximate to self-service gas pumps located in said service zone for use by users of said pumps for hand washing, said wash station comprising:

(a) a cabinet dimensioned to fit within said elongated service zone, the cabinet defining an enclosed volume and having a top surface with a wash basin mounted in said top surface, wherein supports extend upwardly from the top surface on opposite sides of the wash basin transverse to said elongation, and an overhang extends between the supports above the cabinet top surface, wherein the support and the overhang define a sheltered space above the wash basin for shielding the hands of the user from weather elements, said space being accessible by users of the gas pumps from either of the vehicle traffic lanes; and (b) a supply of water located within the cabinet enclosed volume and connected to discharge water into the washbasin via a spigot which is located on one of said opposite sides.

2. The wash station of claim 1 wherein an upwardly extending support has a windshield washing unit mounted thereon.

3. The wash station of claim 1 further comprising a trash receptacle mounted to the cabinet beneath the windshield washing unit.

4. The wash station of claim 1 wherein the overhang has a lower surface spaced above the cabinet top surface and further comprising an overhead paper towel dispenser mounted on the lower surface of the overhang.

5. The wash station of claim 1 including at least one radiant heat unit affixed thereto for radiating heat into the sheltered space, wherein the heat unit is activated by a water initation switch.

6. The outdoor hand wash station of claim 1 wherein the supply of water is contained in a wash water tank, and further comprising:

(a) a switch mounted on the station for initiating the flow of water from the wash water tank through the spigot;

(b) a drain line extending from the washbasin drain to the wash water tank; and (c) a filter disposed between the water spigot and the wash water tank to filter the wash water, the filter being connected such that the wash water leaving the wash water tank will pass through the filter to remove impurities and particulates prior to entry into the wash basin.

7. The wash station of claim 6 wherein the filter is an activated charcoal filter.

8. The wash station of claim 6 wherein the switch is electrically connected to an electrically driven pump adapted to pump water from the wash water tank through the filter to the spigot.

9. The wash station of claim 6 wherein the switch for initiating the flow of water emits a beam of light which passes over the washbasin and wherein the interruption of the beam initiates the flow of water into the washbasin.

10. The wash station of claim 6 further comprising an electric heater disposed within the wash water tank and adapted to heat water located therein.

11. The wash station of claim 6 further comprising a windshield washing unit mounted to a support.

12. The wash station of claim 11 further comprising a trash receptacle mounted to the cabinet beneath the windshield washing unit.

13. The wash station of claim 6 wherein the overhang has a lower surface spaced above the top surface of the cabinet and an overhead paper towel dispenser is mounted on the lower surface of the overhang.

14. The wash station of claim 6 further comprising a submersible pump located within the wash water tank and connected to the filter to pump wash water from the wash water tank to the filter, and wherein actuation of the switch causes the pump to pump wash water through the filter and out the water spigot outlet.

15. The wash station of claim 6 wherein the filter has two in-line fine grain activated charcoal filters.

16. The wash station of claim 6 further comprising at least one radiant heat unit affixed thereto for radiating heat onto a user's hands, wherein the heat unit is activated by the water initiation switch.

17. The wash station of claim 16 further comprising a timing circuit activated by the switch, wherein the timing circuit initiates the flow of water from the water spigot for a first predetermined time period and the timing circuit activates the radiant heat units for a second predetermined time period which is longer than the first time period.

18. The hand wash station of claim 1 wherein the service zone defined alongside a vehicle traffic lane comprises as island which extends upwardly from the level of the vehicle traffic lane.

* * * * *